US005362299A

United States Patent [19]

Schou

[11] Patent Number: 5,362,299

[45] Date of Patent: Nov. 8, 1994

[54] STAMP STORAGE ENVELOPE AND METHOD OF MAKING SAME

[76] Inventor: Diane D. Schou, 2931 Abraham, Cedar Falls, Iowa 50613

[21] Appl. No.: 684,973

[22] Filed: Apr. 15, 1991

[51] Int. Cl.[5] ..... B31B 1/25

[52] U.S. Cl. ..... 493/240; 383/120; 229/928; 493/267; 493/918; 493/947

[58] Field of Search ..... 229/72, DIG. 3; 383/2, 383/120; 493/228, 231, 918, 947, 240, 243, 264, 267, 917

[56] References Cited

U.S. PATENT DOCUMENTS

| | | | |
|---|---|---|---|
| 295,949 | 1/1884 | Sewell | 229/72 X |
| 763,797 | 6/1904 | Rueve, Jr. | 229/72 |
| 975,792 | 11/1910 | Pittman | 229/DIG. 3 X |
| 1,131,135 | 3/1915 | Hudson | 229/72 |
| 1,552,303 | 9/1925 | Hubbard | 229/72 |
| 1,596,088 | 8/1926 | Espey . | |
| 2,333,798 | 11/1943 | Kner | 229/68 |
| 2,704,183 | 3/1955 | Stern | 383/2 X |
| 3,023,947 | 3/1962 | McDuffie | 383/120 X |
| 3,066,847 | 12/1962 | Fortune | 229/68 |
| 3,073,508 | 1/1963 | Hiersteiner | 229/68 |
| 3,198,420 | 8/1965 | Hiersteiner | 229/DIG. 3 X |
| 3,552,640 | 1/1971 | Young | 229/DIG. 3 X |
| 3,601,925 | 8/1971 | Bolling | 383/120 X |
| 4,667,819 | 5/1987 | Lu | 206/312 |
| 4,974,652 | 12/1990 | Lemler | 150/147 |

FOREIGN PATENT DOCUMENTS

| | | | |
|---|---|---|---|
| 547177 | 8/1942 | United Kingdom | 383/120 |

*Primary Examiner*—Allan N. Shoap
*Assistant Examiner*—Jes F. Pascua
*Attorney, Agent, or Firm*—Zarley, McKee, Thomte, Voorhees, & Sease

[57] ABSTRACT

A stamp storage envelope is constructed from a single sheet of material which allows for varying the size of the access opening into the storage chamber by how many panels of end walls are overlapped with each other or adjacent front and rear walls. The panels may be secured to each other and the front and rear walls by adhesive.

4 Claims, 2 Drawing Sheets

STAMPS
10
26
20
24
12
14

40
10
24
26
30
28
18
6
32
28
30
20
16
12
14
42
6

40
24
10
18
28
30
32
42
12
14
20
28
30

40
10
32
24
26
16
30
28
20
28
30
18
12
14
42

40
26
10
24
20
22
28
16
28
14
18
30
12
30

STAMP STORAGE ENVELOPE AND METHOD OF MAKING SAME

BACKGROUND OF THE INVENTION

A stamp envelope is desirable to protect stamps from soiling and to organize them in a practical way when being stored in drawers, briefcases and hand bags. The envelope may provide informative postal information for first class, overweight, oversized items, postcards and international rates and to help identify appropriate mail size limitations.

The envelope must require a minimum of materials and be simple to assemble. It should be possible to construct the envelope from a single sheet of continuous material but be able to vary the maximum distance between the front and rear of panels when in an open condition.

Representative prior art envelopes are disclosed in the E. V. Hudson U.S. Pat. No. 1,131,135, Mar. 9, 1915 and H. Rueve, Jr., U.S. Pat. No. 763,797, Jun. 28, 1904.

The shortcoming of the prior art envelopes is that there is no simple, inexpensive way of varying the maximum distance between the front and rear walls when in an open condition without constructing the end walls from pieces of material separate from the front end rear walls. Thus, what is needed is an envelope and method of making same that readily allows for constructing the envelope with a variable access opening into the storage chamber between the front and rear panels while utilizing a single sheet of material.

SUMMARY OF THE INVENTION

The storage envelope of this invention is constructed from a single sheet of continuous material which allows for a variable access opening into the storage chamber. The front and rear walls will be limited in how far they will fold to an open position by the effective length of the opposite end walls comprising a plurality of triangular shaped panels. The variable distance between the front and rear walls is determined by overlapping one or more panels in the end walls with adjacent panels or an adjacent front wall or rear wall. Adhesive may be used for this purpose. A single panel may be secured to the front or rear wall or to an adjacent interconnected panel. This step may be multiplied as often as is necessary to provide the desired maximum opening between the front and rear walls.

DESCRIPTION OF PREFERRED EMBODIMENT

Figures 1, 2, 3, 4, 5:
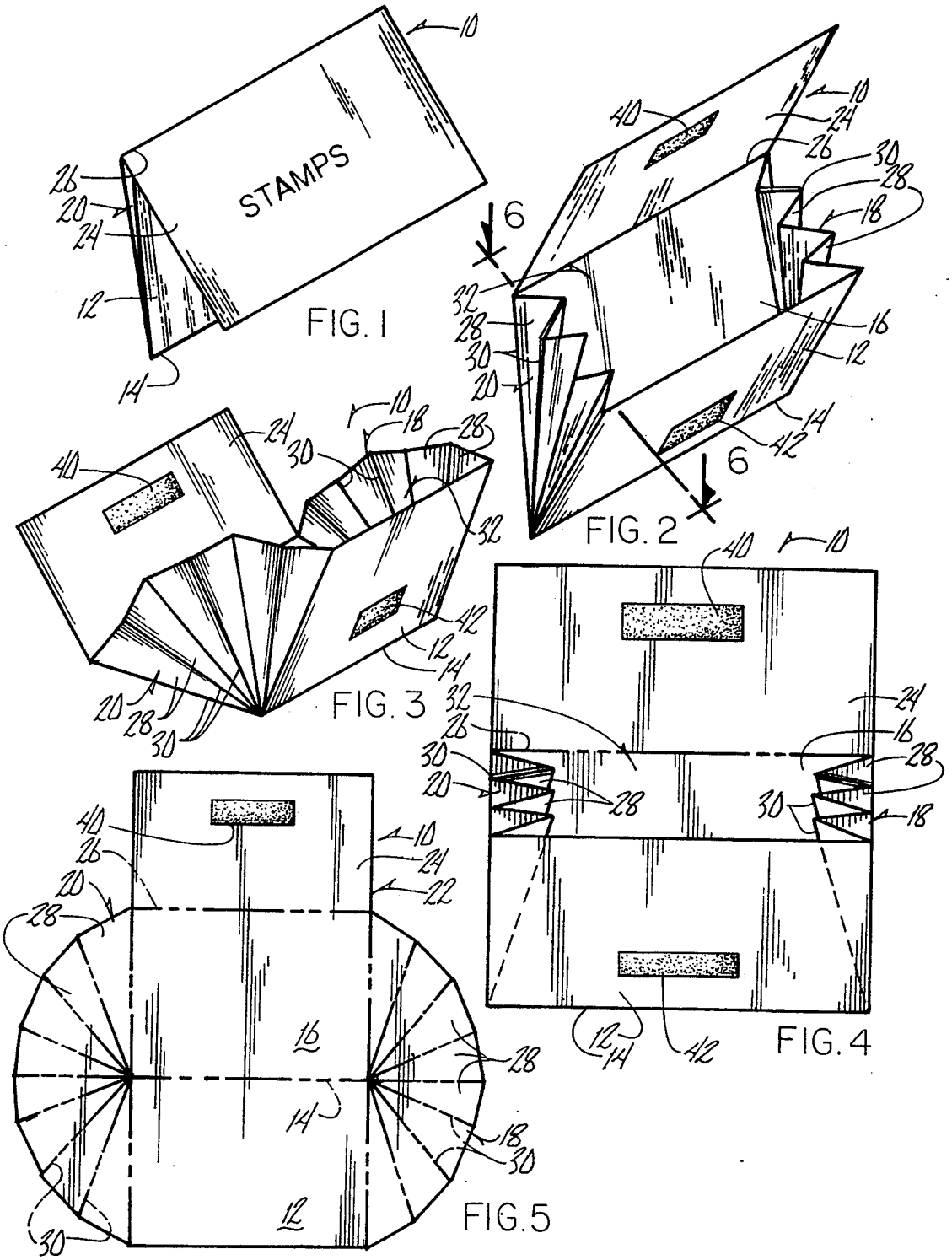
FIG. 1 is a front perspective view of the stamp storage envelope of this invention.
FIG. 2 is a front perspective view of the envelope in a partially open condition.
FIG. 3 is a front perspective view of the envelope in a fully opened condition.
FIG. 4 is a front elevational view thereof.
FIG. 5 is a top plan view of the single sheet of material from which the envelope is constructed.

A stamp envelope referred to generally by the reference numeral 10 is shown in FIG. 1 and includes a front wall 12 connected by a fold 14 to a rear wall 16. Oppositely disposed end walls 18 and 20 interconnect the front and rear walls 12 and 16.

In FIG. 5 it can be seen that a single sheet of material 22 is used to construct the envelope 10. The sheet 22 is scored to provide fold lines between the various component integral parts. A closure flap 24 is connected through a fold line 26 to the top edge of the rear wall 16. It is seen that 8 panels 28 are formed in the end walls 18 and 20 and are interconnected along fold lines 30.

Figure 6:
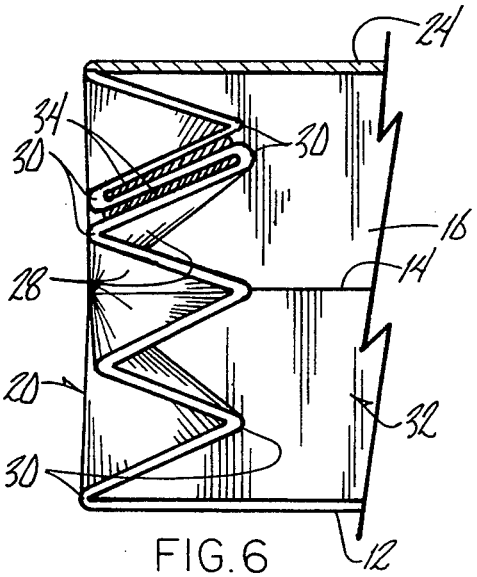
FIG. 6 is a cross-sectional view taken along line 6—6 in FIG. 2 illustrating three interconnected panels being secured together by adhesive in parallel overlapping relationship.

A storage chamber 32 is provided when the sheet 22 is assembled into an envelope and the size of the access opening and the chamber is determined by how many panels 28 are overlapped with each other or the front and rear walls 12 and 16. In FIG. 6 it is seen that three triangular shaped panels 28 are overlapped in contiguous parallel relationship and held there by adhesive 34.

Figure 7:
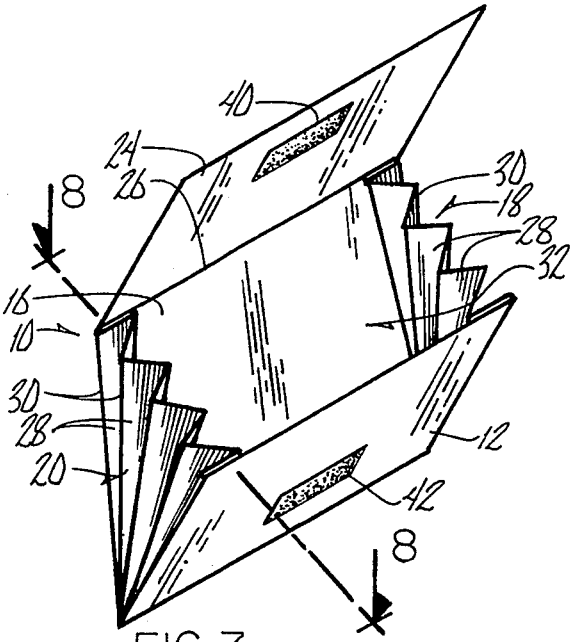
FIG. 7 is a front perspective view of an alternate embodiment of the envelope wherein the front and rear walls are glued to the adjacent panels of the end walls to limit the access opening into the envelope chamber.
Figure 8:
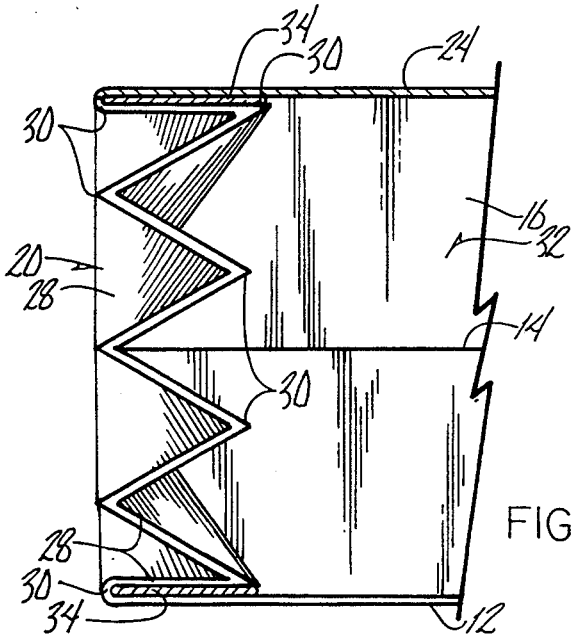
FIG. 8 is a cross-sectional view taken along line 8—8 in FIG. 7.

In an alternate embodiment shown in FIGS. 7 and 8 triangular shaped panels 28 adjacent the front and rear walls 12 and 16 are secured thereto by adhesive 34. It is thus seen that any combination of these procedures may be utilized to provide the desired maximum distance that the front and rear panels 12 and 16 will open relative to each other.

The closure flap 24 may be locked to the front wall 12 through the use of Velcro® fasteners 40 and 42. The material used in the construction of the envelope may be of selected card stock or any other desired suitable material.

What is claimed is:

1. The method of making a storage envelope having front and rear walls interconnected by oppositely disposed end walls including a plurality of interconnected panels defining a storage chamber therebetween, comprising the steps of:

providing a single sheet of continuous material, scoring said sheet of material to provide fold lines between said plurality of interconnected panels and said front and rear walls, and providing an arcuate exterior edge on said plurality of interconnected panels, said arcuate edge extending from said front wall to said rear wall, folding said sheet of material along said fold lines and shaping said sheet to form said envelope, determining the maximum desired distance between said front and rear walls when said envelope is in an open condition, and securing and maintaining at least one of said panels in each end wall in an overlapped contiguous parallel relationship with one of an adjacent panel, front and rear wall.

2. The structure of claim 1 wherein said step of securing and maintaining at least one of said panels in each end wall in an overlapped contiguous parallel relationship with an adjacent panel, front or rear wall is further defined by said one panel being in an overlapped contiguous parallel relationship with an adjacent panel.

3. The method of claim 12 wherein said one panel is further defined as being one of three consecutively interconnected panels in overlapped parallel relationship.

4. The method of claim 11 wherein said step of securing and maintaining at least one of said panels in each end wall in an overlapped contiguous parallel relationship with an adjacent panel, front or rear wall is further defined by said one panel being in an overlapped contiguous parallel relationship with a front or rear wall.

* * * * *